US012226061B2

(12) United States Patent
Sun et al.

(10) Patent No.: US 12,226,061 B2
(45) Date of Patent: Feb. 18, 2025

(54) BASE STATION OF CLEANING DEVICE AND CLEANING SYSTEM

(71) Applicant: MIDEA ROBOZONE TECHNOLOGY CO., LTD., Suzhou (CN)

(72) Inventors: Tao Sun, Suzhou (CN); Tao Zhang, Suzhou (CN); Xianmin Wei, Suzhou (CN); Xiaogang Xuan, Suzhou (CN)

(73) Assignee: MIDEA ROBOZONE TECHNOLOGY CO., LTD., Suzhou (CN)

( * ) Notice: Subject to any disclaimer, the term of this patent is extended or adjusted under 35 U.S.C. 154(b) by 47 days.

(21) Appl. No.: 18/546,973

(22) PCT Filed: May 11, 2021

(86) PCT No.: PCT/CN2021/093162
§ 371 (c)(1),
(2) Date: Aug. 18, 2023

(87) PCT Pub. No.: WO2022/174522
PCT Pub. Date: Aug. 25, 2022

(65) Prior Publication Data

US 2024/0130597 A1 Apr. 25, 2024
US 2024/0225404 A9 Jul. 11, 2024

(30) Foreign Application Priority Data

Feb. 18, 2021 (CN) ..... 202110188043.7

(51) Int. Cl.
*A47L 11/40* (2006.01)
*A47L 11/24* (2006.01)
*A47L 11/28* (2006.01)

(52) U.S. Cl.
CPC ..... *A47L 11/4083* (2013.01); *A47L 11/24* (2013.01); *A47L 11/28* (2013.01); *A47L 11/4091* (2013.01); *A47L 2201/026* (2013.01)

(58) Field of Classification Search
CPC ..... A47L 11/4083; A47L 11/24; A47L 11/28; A47L 11/4091; A47L 2201/026
(Continued)

(56) References Cited

U.S. PATENT DOCUMENTS

2020/0405107 A1 12/2020 Na et al.

FOREIGN PATENT DOCUMENTS

CN 109419460 A 3/2019
CN 110375427 A 10/2019
(Continued)

OTHER PUBLICATIONS

CN-212394813-U- English Translation (Year: 2021).*
(Continued)

*Primary Examiner* — Craig M Schneider
*Assistant Examiner* — Christopher M Afful

(57) ABSTRACT

A base station of a cleaning device and a cleaning system are provided. The base station of the cleaning device includes: a base station body having an accommodating chamber for accommodating the cleaning device and an opening for the cleaning device to enter or exit the accommodating chamber; and a water injection assembly including a movable base, and a movable plate, a lifting mechanism, and a water injection pipe that are disposed on the movable base. The water injection pipe is configured to inject water into the cleaning device. The lifting mechanism is configured to drive the water injection pipe to move. A first elastic member is disposed between the movable plate and a side wall of the
(Continued)

accommodating chamber. The cleaning device is contacted with the movable plate during a water injection process of the water injection assembly.

20 Claims, 7 Drawing Sheets

(58) Field of Classification Search
USPC ..... 141/284
See application file for complete search history.

(56) References Cited

FOREIGN PATENT DOCUMENTS

| | | | | |
|---|---|---|---|---|
| CN | 110417071 | A | | 11/2019 |
| CN | 111956125 | A | | 11/2020 |
| CN | 211911517 | U | | 11/2020 |
| CN | 212394813 | U | * | 1/2021 |

OTHER PUBLICATIONS

International search report received in the corresponding international application PCT/CN2021/093162, mailed Nov. 10, 2021.

* cited by examiner

BASE STATION OF CLEANING DEVICE AND CLEANING SYSTEM

CROSS-REFERENCES TO RELATED APPLICATIONS

The present disclosure is a national phase application of International Application No. PCT/CN2021/093162, filed on May 11, 2021, which claims priority to Chinese Patent Application No. 202110188043.7, filed on Feb. 18, 2021, the entire content of which is incorporated herein by reference.

FIELD

The present disclosure relates to the field of cleaning appliances, and more particularly, to a base station of a cleaning device and a cleaning system.

BACKGROUND

With the progress of science and technology, people have higher and higher requirements for quality of life, and have gradually increased demand for indoor cleaning. With respect to user demands for floor sweeping and floor mopping, more and more products realize both floor sweeping and floor mopping on one device, resulting in more convenient indoor cleaning with less manual intervention.

It is worth noting that a currently used water injection method for a robot cleaner is docking a bottom of the robot to a base station to facilitate water injection. However, on one hand, the water injection method has relatively higher requirements for docking accuracy between the robot and the base station, and on the other hand, the method has relatively higher requirements for sealing a docking interface, to lead to a bad effect of water injection by the base station to the robot ultimately.

SUMMARY

The present disclosure aims to solve, at least to some extent, the above problems in the related art. To this end, the present disclosure provides a base station of a cleaning device and a cleaning system, to solve at least one of the above problems.

In order to achieve the above objects, the base station of the cleaning device is provided according to the present disclosure in some embodiments. The base station of the cleaning device includes: a base station body having an accommodating chamber for accommodating the cleaning device and an opening for the cleaning device to enter or exit the accommodating chamber; and a water injection assembly including a movable base, and a movable plate, a lifting mechanism, and a water injection pipe that are disposed on the movable base, the water injection pipe being configured to inject water into the cleaning device, the lifting mechanism being configured to drive the water injection pipe to move, a first elastic member being disposed between the movable plate and a side wall of the accommodating chamber, and the cleaning device being contacted with the movable plate during a water injection process of the water injection assembly.

The cleaning system is provided according to the present disclosure in other embodiments, and includes the base station as described above and the cleaning device.

In addition, the base station of the cleaning device according to the present disclosure may have additional features as follows.

According to some embodiments of the present disclosure, the lifting mechanism includes: a drive motor mounted on the movable base; a nut rotatably mounted in the movable base and connected to an output end of the drive motor; and a lead screw extending through the nut and engaged with the nut, the water injection pipe being fixedly mounted on the lead screw.

According to some embodiments of the present disclosure, a limit protruding rib is disposed on the movable base. A limit groove is set on the lead screw, and the limit groove matches the limit protruding rib to limit a position of the lead screw.

According to some embodiments of the present disclosure, the base station of the cleaning device further includes a controller. A water volume sensor is disposed on the water injection pipe, and the controller is configured to control lifting up of the water injection pipe based on water volume information of the cleaning device fed back by the water volume sensor.

According to some embodiments of the present disclosure, a charging spring piece is disposed on the movable plate, and the charging spring piece is configured to abut against a charging terminal of the cleaning device for charging the cleaning device.

According to some embodiments of the present disclosure, the base station of the cleaning device further includes two guiding mechanisms spaced apart from each other and symmetrically disposed in the base station body. The two guiding mechanisms for generating opposing forces on opposite sides of the cleaning device, to guide the cleaning device to move along a centerline of the accommodating chamber.

According to some embodiments of the present disclosure, each of the guiding mechanisms includes: a first crank having an inner stressed end and an outer stressed end, the first crank extending, from the inner stressed end to the outer stressed end, outward obliquely; a second crank having one end rotatably connected to the base station body and the other end rotatably connected to a middle portion of the first crank; a second elastic member having one end fixed on the outer stressed end and the other end fixed on the second crank; and a third elastic member having one end fixed on the second crank and the other end fixed on the base station body, the inner stressed end being subjected to an external force from the cleaning device, and the outer stressed end moving in a direction close to the cleaning device until the inner stressed end and the outer stressed end abut against a side wall of the cleaning device.

According to some embodiments of the present disclosure, each of the guiding mechanisms includes: a lever member having a pivot connected to the base station body, an inner stressed end and an outer stressed end, the lever extending, from the inner stressed end to the outer stressed end, outward obliquely; and a fourth elastic member disposed between the base station body and the lever member and configured to reset the lever member, the inner stressed end being subjected to an external force from the cleaning device, and the outer stressed end moving in a direction close to the cleaning device until the inner stressed end and the outer stressed end abut against a side wall of the cleaning device.

According to some embodiments of the present disclosure, a guide wheel is mounted on each of the inner stressed end and the outer stressed end.

According to some embodiments of the present disclosure, each of the guiding mechanisms is a guide strip mounted in the accommodating chamber. A channel for the cleaning device to move is formed between the two guide strips. The opening is located at a front end of the channel. Each of the guide strips includes a first guide segment disposed close to the front end of the channel and a second guide segment connected to the first guide segment. The two second guide segments are parallel to each other, and each of the two first guide segments extends obliquely, from a connection with the respective second guide segment, to the opening in a direction away from each other.

Compared with the related art, the present disclosure has the following beneficial effects.

Firstly, via an interconnection and cooperation between the movable plate and the water injection pipe, when the cleaning device touches the movable plate, the movable plate drives the water injection pipe in a direction close to the first elastic member. On one hand, a tight contact between the movable plate and the cleaning device is realized during a water injection process, and on the other hand, the water injection pipe is self-adapted to be aligned to the water injection port of the cleaning device, which improves an alignment accuracy between the water injection pipe and the cleaning device.

Secondly, the two guiding mechanisms generate opposing forces on opposite sides of the cleaning device, to guide the cleaning device to move along a centerline of the accommodating chamber, and the cleaning device can accurately reach a predetermined position, which improves a position accuracy of the cleaning device entering the base station.

BRIEF DESCRIPTION OF THE DRAWINGS

In order to clearly explain the embodiments of the present disclosure, drawings used in the description of the embodiments are briefly described below. The drawings as described below are merely some embodiments of the present disclosure. Based on these drawings, other drawings can be obtained.

Figure 1:
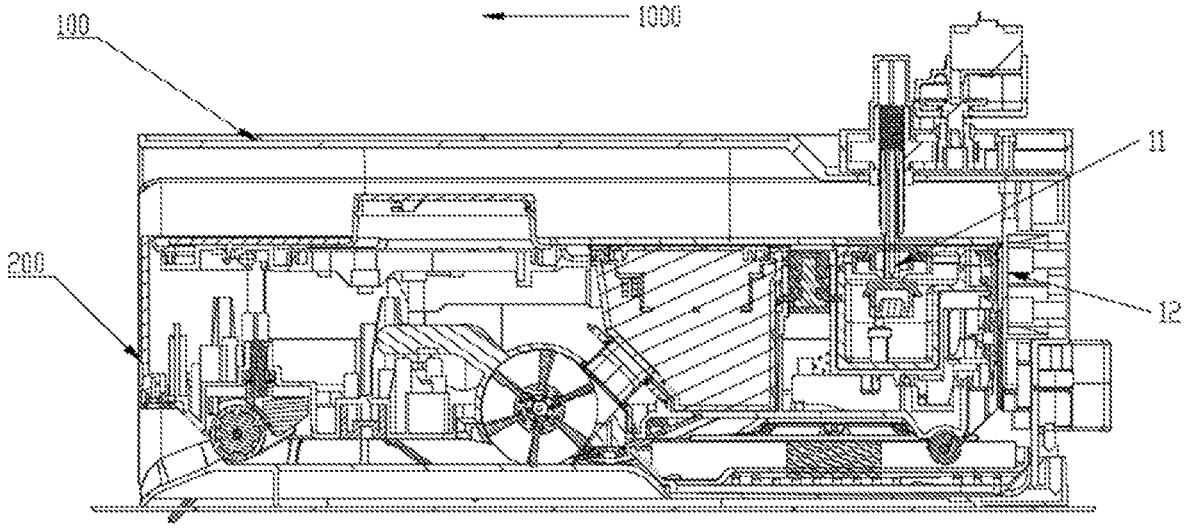
FIG. 1 is a cross-sectional view of a cleaning system according to an embodiment of the present disclosure.

The reference signs are explained as follows:

cleaning system 1000; base station 100; base station body 10; accommodating chamber 101; opening 102; station base 103; station upper cover 104; base foundation 105; side wall 106; rear wall 107; slider 108; water injection pipe 11; movable plate 12; movable base 13; upper cover 130; slide groove 1301; lower cover 131; first avoidance hole 132; second avoidance hole 133; limit protruding rib 134; water volume sensor 14; charging spring piece 15; drive motor 18; nut 19; lead screw 20; limit groove 201; mounting box 22; upper box cover 220; lower box cover 221; first crank 23; inner stressed end 230; outer stressed end 231; second crank 24; second elastic member 25; third elastic member 26; guide wheel 27; lever member 28; fourth elastic member 29; guide strip 30; first guide segment 301; second guide segment 302; channel 31; cleaning device 200.

Embodiments of the present disclosure will be further described in conjunction with embodiments and with reference to the accompanying drawings.

DETAILED DESCRIPTION OF THE DISCLOSURE

Exemplary embodiments of the present disclosure will be described in detail below with reference to the accompanying drawings. While exemplary embodiments of the present disclosure are illustrated in the accompanying drawings, it should be understood that the present disclosure may be embodied in various forms and should not be construed as being limited to the embodiments set forth herein. These embodiments are provided for a more thorough understanding of the present disclosure.

It should be understood that terms used herein are intended to describe particular example embodiments only and are not intended to limit the embodiments. Unless otherwise clearly indicated by the context, singular forms of "a", "one", and "said" as used herein can also be interpreted as including plural forms. Terms "include", "comprise", and "have" are inclusive and therefore specify the presence of stated features, elements, and/or components, but do not preclude the presence or an addition of one or more other features, elements, components, and/or a combination thereof.

In the description of the present disclosure, unless otherwise clearly specified and limited, terms such as "dispose" and "connect to" should be understood in a broad sense. For example, it may be a fixed connection or a detachable connection or connection as one piece; direct connection or indirect connection through an intermediate. The specific meaning of the above-mentioned terms in the present disclosure can be understood according to specific circumstances.

In addition, terms "first" and "second" are only used for descriptive purposes, and cannot be understood as indicating or implying relative importance or implicitly indicating the number of indicated features. Therefore, the features defined with "first" and "second" may explicitly or implicitly include at least one of the features. In the description of the present disclosure, "plurality" means at least two, such as, two or three, unless otherwise specifically defined.

For ease of description, spatially relative terms such as "bottom", "front", "upper", "incline", "lower", "top", "inner", "horizontal", "outer", etc., may be used herein to describe a relation of one element or feature illustrated in the figures to another element or feature illustrated in the figures. These spatially relative terms are intended to include different orientations of mechanisms in use or operation in addition to those depicted in the figures. For example, if a mechanism in the figure is flipped over, an element described as "under other elements or features" or "below other elements or features" will then be oriented as "above other elements or features" or "on other elements or features". Thus, the example term "below . . . " may include orientations of above and below.

With reference to FIG. 1 to FIG. 4, a base station 100 of a cleaning device is provided by some embodiments of the present disclosure. It should be noted that the present disclosure is described in detail taking a cleaning device 200 being a robot cleaner as an example. The cleaning device 200 may be other cleaning devices, such as vacuum cleaners or others, which will not be repeated in the present embodiments.

In an embodiment of the present disclosure, the base station 100 includes a base station body 10, a water injection pipe 11, a lifting mechanism, a movable plate 12, a movable base 13, a water volume sensor 14, a charging spring piece 15, and a guiding mechanism. The water injection pipe 11, the lifting mechanism, the movable plate 12, and the movable base 13 form a water injection assembly on the base station 100. The base station body 10 has an accommodating chamber 101 and an opening 102 for the cleaning device 200 to enter or exit the accommodating chamber 101. The water injection pipe 11 is configured to inject water into the cleaning device 200 within the accommodating chamber 101. It should be noted that a water injection port of the cleaning device 200 is disposed on a top surface of the cleaning device 200. The water injection pipe 11 is disposed above the cleaning device 200, i.e., a water flow can flow downwardly into the cleaning device 200 from the water injection pipe 11 above the cleaning device 200.

It is worth noting that the lifting mechanism is disposed on the base station body 10, which is configured to drive the water injection pipe 11 to move up and down. When the base station 100 does not inject water into the cleaning device 200, the water injection pipe 11 is disposed above the water injection port of the cleaning device 200 and is not inserted into the water injection port of the cleaning device 200. When the base station 100 needs to inject water into the cleaning device 200, the water injection pipe 11 descends under a drive of the lifting mechanism until the pipe is inserted into the water injection port of the cleaning device 200.

It should be noted that the water injection pipe 11 is a hollow pipe body. One end of the water injection pipe is connected to an external water supply system, and the other end of the water injection pipe has an opening formed on a side surface thereof. After the water injection pipe 11 inserts into the water injection port of the cleaning device 200, no blocking structural member exists in a direction of water discharge, which avoids splashing of the water flow.

Figure 2:
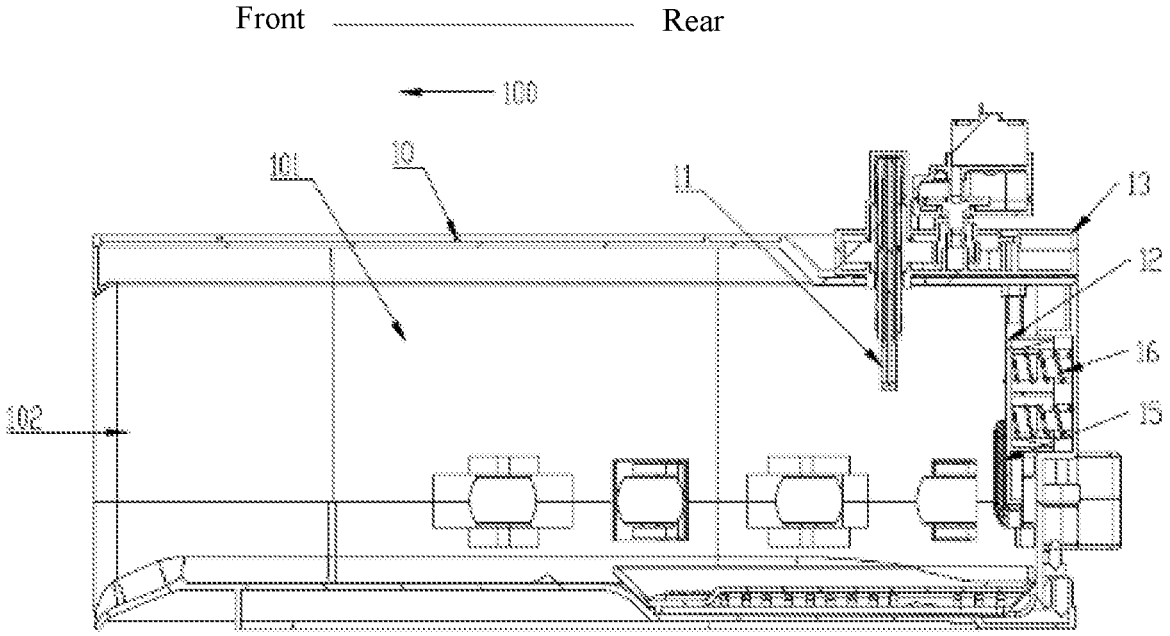
FIG. 2 is a first cross-sectional view of the base station in FIG. 1.

Further, continuing to refer to FIG. 2, the movable plate 12 is disposed in the accommodating chamber 101 and is opposite to the opening 102. The movable plate 12 is disposed on an inner side of the water injection pipe 11. A first elastic member 16 is disposed between the movable plate 12 and a rear wall surface of the accommodating chamber 101. The movable plate 12 linkage cooperates with the water injection pipe 11. When a side wall of the cleaning device 200 abuts against the movable plate 12, the movable plate 12 drives the water injection pipe 11 to slide in a direction close to the first elastic member 16, to realize an alignment between the water injection pipe 11 and the water injection port of the cleaning device 200.

It should be noted that, continuing to refer to FIG. 2, the opening 102 is located at a front end of the accommodating chamber 101. The movable plate 12 and the first elastic member 16 are located at positions at a rear end of the accommodating chamber 101. The cleaning device 200 enters from the opening 102 at the front end of the accommodating chamber 101, and moves to a predetermined position of the accommodating chamber 101 where the side wall of the cleaning device 200 can abut against the movable plate 12 and a backward force is generated on the movable plate 12. Then the movable plate 12 is forced to drive the water injection pipe 11 backward, and compress the first elastic member 16. After the first elastic member 16 is compressed and deformed, the first elastic member generates a forward elastic force on the movable plate 12, which makes the movable plate 12 in tight contact with the side wall of the cleaning device 200. At the same time, the water injection pipe 11 is accurately aligned with the water injection port of the cleaning device 200, avoiding splashing of the water flow caused by a positional error between the water injection pipe 11 and the water injection port of the cleaning device 200.

In an embodiment of the present disclosure, continuing to refer to FIG. 2, the base station 100 further includes the movable base 13 slidably disposed on the base station body 10. The movable plate 12, the lifting mechanism, and the water injection pipe 11 are mounted on the movable base 13. The movable base 13 is slidable horizontally in a front-rear direction relative to the base station body 10 under a drive of the movable plate 12. In a further embodiment, the movable plate 12, the lifting mechanism, and the water injection pipe 11 are integrally fixed to the movable base 13. In this way, the movable plate 12 can drive the movable base 13, and the lifting mechanism and the water injection pipe 11 that are disposed on the movable base 13 to move, to realize a synchronized movement of multiple members.

Figure 3:
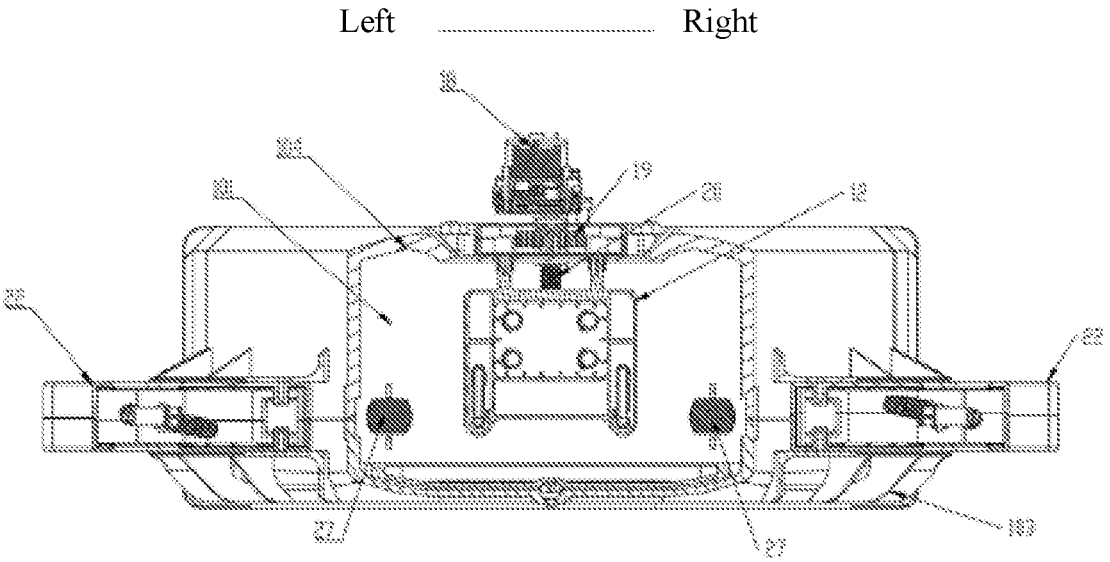
FIG. 3 is a second cross-sectional view of the base station in FIG. 1.
Figure 4:
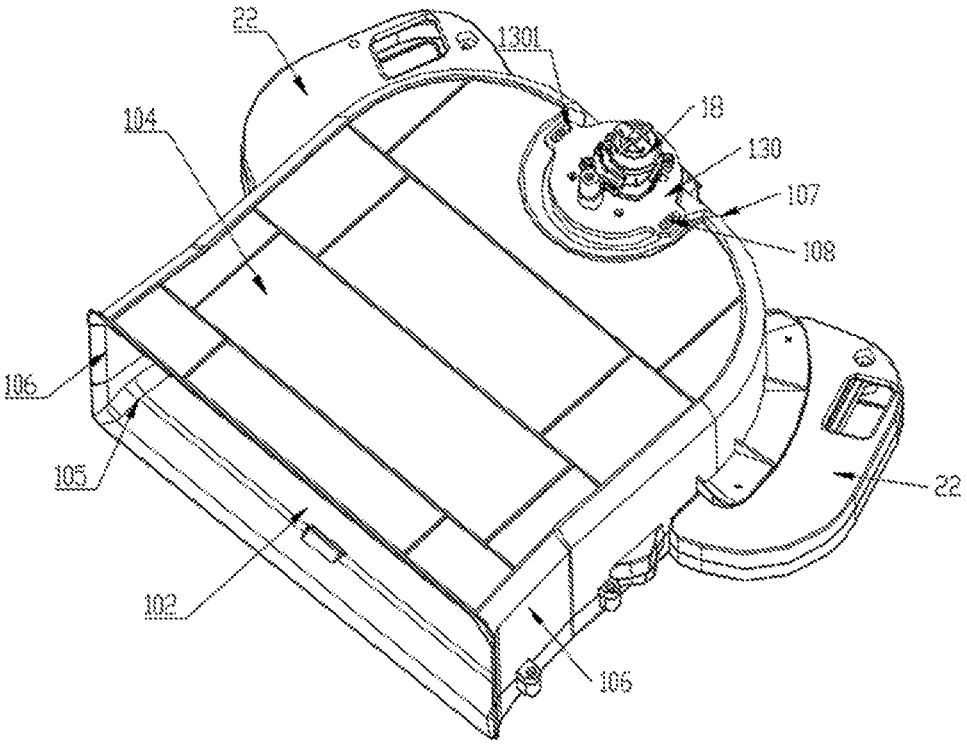
FIG. 4 is a three-dimensional view of the base station in FIG. 1.

Continuing to refer to FIG. 3 and FIG. 4, it is worth noting, that the base station body 10 serves as a mounting base for other structural members on the base station 100 and as a carrying structure for the cleaning device 200. The base station body 10 is not limited to a structure according to embodiments of the disclosure, and can be a monolithic structure, or be composed of two or more mechanisms. As an example, the base station body 10 includes a station base 103 and a station upper cover 104. The station base 103 and station upper cover 104 enclose to form the accommodating chamber 101. The station base 103 includes a base foundation 105, and two side walls 106 and a rear wall 107 that are formed on the base foundation 105. A front side of station base 103 is open to form the opening 102, and the station upper cover 104 closes over the two side walls 106 and the rear wall 107 of the station base 103.

Figure 5:
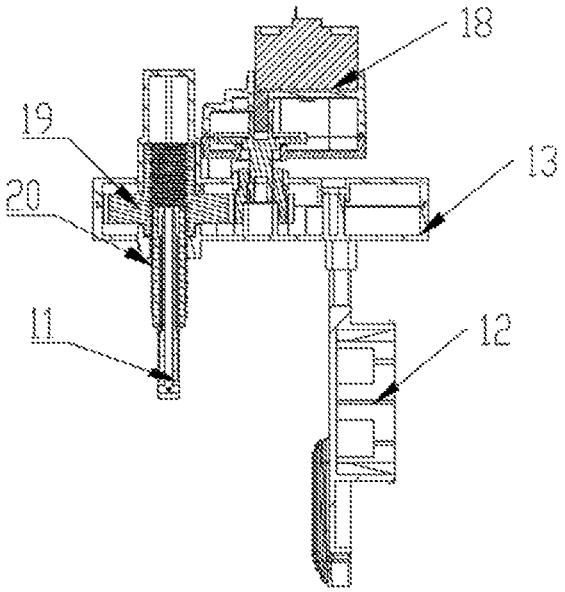
FIG. 5 is a schematic diagram of a partial structure of the base station in FIG. 1.
Figure 6:
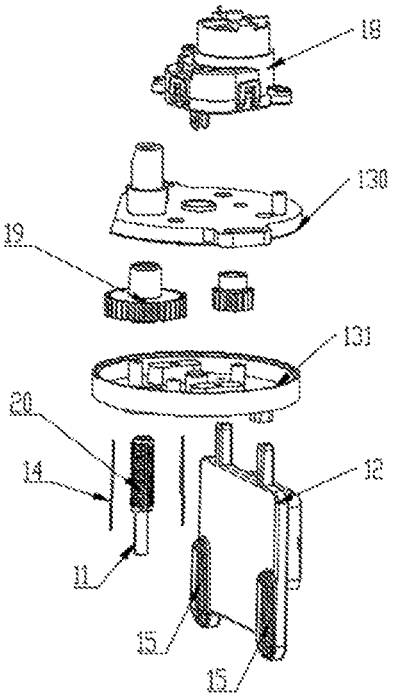
FIG. 6 is an exploded view of FIG. 5.

In some embodiments of the present disclosure, as illustrated in FIG. 5 and FIG. 6, the movable base 13 is formed by snapping together an upper cover 130 and a lower cover 131. The upper cover 130 and the lower cover 131 form a cavity for mounting a portion of the lifting mechanism after being snapped together. A slide groove 1301 is set on each of opposite sides of the upper cover 130, and a slider 108 for adapting to the slide groove 1301 is disposed on the upper cover 104.

Continuing to refer to FIG. 5 and FIG. 6, the lifting mechanism includes: a drive motor 18, a nut 19, and a lead screw 20. The drive motor 18 is mounted on an upper portion of the upper cover 130. The nut 19 is connected to an output end of the drive motor 18, and the nut 19 is rotatably mounted in the cavity of the movable base 13. The lead screw 20 extends through a middle portion of the nut 19, and the lower cover 131. The water injection pipe 11 is connected to the lead screw 20. In a further embodiment, external threads of the lead screw 20 and internal threads of the nut 19 engage with each other. In this way, when the drive motor 18 drives the nut 19 to rotate, the lead screw 20 can drive the water injection pipe 11 to move up and down under a drive of the nut 19.

It should be noted that the present embodiment only illustrates the lifting mechanism in a cooperation manner with a nut and a lead screw. The lifting mechanism according to the present disclosure is not limited to thereto, and the lifting mechanism that can drive the water injection pipe 11 to move up and down is within the protection scope of the present disclosure.

Figure 7:
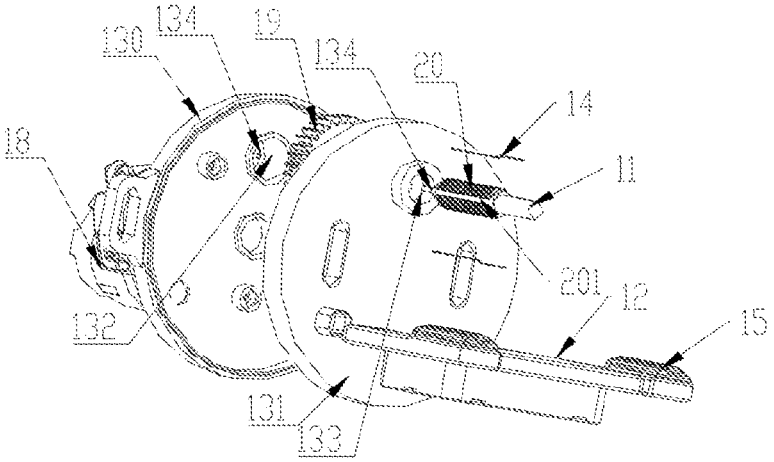
FIG. 7 is a side view of FIG. 6.

In some embodiments of the present disclosure, as illustrated in FIG. 7, a first avoidance hole 132 and a second avoidance hole 133 are set on the upper cover 130 and the lower cover 131 for the lead screw 20 to move up and down. A limit protruding rib 134 is disposed on each of a hole wall of the first avoidance hole 132 and a hole wall of the second avoidance hole 133. A limit groove 201 for adapting to the limit protruding rib 134 is set on the lead screw 20 in a length direction of the lead screw 20. A limit mechanism of the lead screw 20 can be formed by the limit protruding ribs 134 and the limit groove 201. The limit protruding ribs 134 can limit a rotational freedom of the lead screw 20 during a rise or fall of the lead screw 20, and in turn limit a rise or fall position of the lead screw 20, avoiding the lead screw 20 from rising too high or falling too low.

Continuing to refer to FIG. 5 to FIG. 7, the base station 100 further includes a controller and a water volume sensor 14. The controller is connected to the water volume sensor 14 and the drive motor 18 of the lifting mechanism. The water volume sensor 14 can be a metal piece. In a further embodiment, the water volume sensor 14 is mounted on each of opposite sides of an outer wall of the water injection pipe 11. When a water level in the cleaning device 200 rises over the water volume sensor 14, it means that the water in the cleaning device 200 is full. The water volume sensor 14 will feed back information that the water in the cleaning device 200 is full to the controller. The controller controls the external water supply system to stop operating, and controls the drive motor 18 to drive the water injection pipe 11 to rise, completing the water injection.

In some embodiments of the present disclosure, continuing to refer to FIG. 2, the charging spring piece 15 is disposed on a front wall of the movable plate 12. The charging spring piece 15 is configured to abut against a charging terminal of the cleaning device 200 to realize a charging of the base station 100 to charge the cleaning device 200. It should be noted that when the movable plate 12 is in tight contact with the cleaning device 200, a tight contact between the charging spring piece 15 on the movable plate 12 and the charging terminal of the cleaning device 200 is simultaneously realized, to avoid a poor contact between the charging spring piece 15 and the charging terminal of the cleaning device 200.

Referring to FIG. 3 and FIG. 4, the base station 100 includes two guiding mechanisms, which are spaced apart from each other and symmetrically disposed in the base station body 10. The two guiding mechanisms may be for generating opposing and equal forces on the opposite sides of the cleaning device 200, to guide the cleaning device 200 to move along a centerline of the accommodating chamber 101. In a further embodiment, the two guiding mechanisms are disposed on a left and a right side of the base station body 10, respectively.

During a traveling process of the cleaning device 200, when the cleaning device 200 is biased to the left side, a force of the cleaning device 200 on a left guiding mechanism is greater than a force of the cleaning device 200 on a right guiding mechanism. At this time, a counter force of the left guiding mechanism on the cleaning device 200 is greater than a counter force of the right guiding mechanism on the cleaning device 200. The cleaning device 200 slowly moves toward a right side under the counter force of the left guiding mechanism until the cleaning device 200 has an equal force on the left and right guiding mechanisms, and the cleaning device 200 moves along the centerline under an action of the left and right guiding mechanisms. When the cleaning device 200 is biased to the right side, vice versa, which will not be repeated herein.

Figure 8:
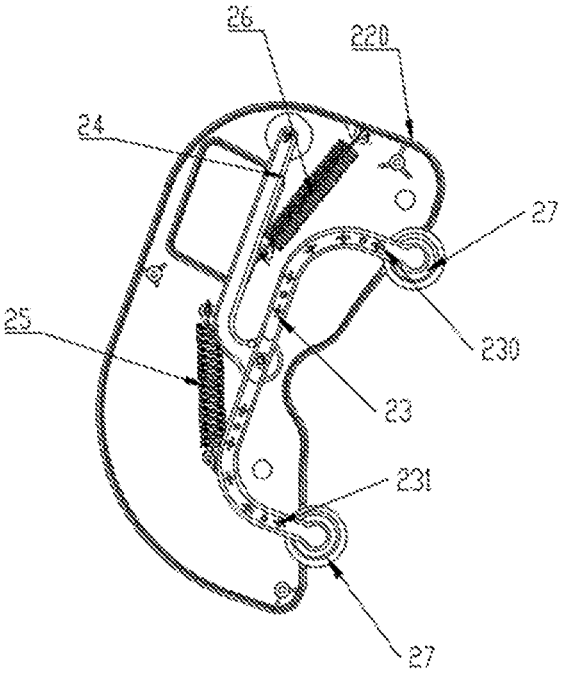
FIG. 8 is a schematic diagram of a structure of a guiding mechanism of the base station in FIG. 1.
Figure 9:
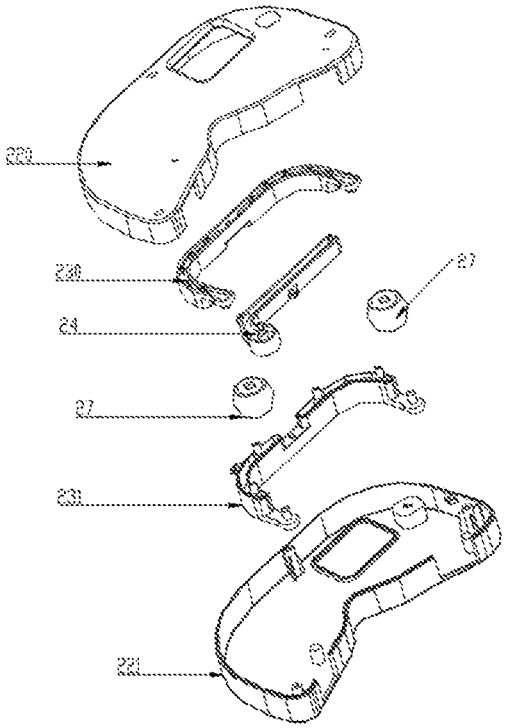
FIG. 9 is an exploded view of FIG. 8.

In some embodiments of the present disclosure, continuing to refer to FIG. 3 to FIG. 4 and as illustrated in FIG. 8 and FIG. 9, the base station 100 further includes two mounting boxes 22 for mounting the guiding mechanisms. The two mounting boxes 22 are symmetrically disposed on opposite sides and on the two side walls 106 and are disposed at positions at a rear end of the side walls 106. Each of the mounting boxes 22 is formed by snapping an upper box cover 220 and a lower box cover 221 together, and the upper box cover 220 and the lower box cover 221 snapping together to form a mounting cavity in communication with the accommodating chamber 101.

Continuing to refer to FIG. 8 and FIG. 9, each of the guiding mechanisms may include: a first crank 23, a second crank 24, a second elastic member 25, and a third elastic member 26. The first crank 23 is formed by snapping together an upper case 230 and a lower case 231. The first crank 23, the second crank 24, the second elastic member 25, and the third elastic member 26 are mounted in the mounting box 22. The first crank 23 has an inner stressed end 230 and an outer stressed end 231 that may extend into the accommodating chamber 101. From the inner stressed end 230 to the outer stressed end 231, the first crank 23 extends outward obliquely. One end of the second crank 24 is rotatably connected to the upper box cover 220, and the other end of the second crank 24 is rotatably connected to a middle portion of the first crank 23. One end of the second elastic member 25 is fixed on the outer stressed end 231, and the other end of the second elastic member 25 is fixed on the second crank 24. One end of the third elastic member 26 is fixed on the second crank 24, and the other end of the third elastic member 26 is fixed on the upper box cover 220. The inner stressed end 230 is subjected to an external force from the cleaning device 200, and the outer stressed end 231 moves in a direction close to the cleaning device 200 until the inner stressed end 230 and the outer stressed end 231 abut against the side wall of the cleaning device 200.

Continuing to refer to FIG. 8 and FIG. 9, a guide wheel 27 is movably connected to each of the inner stressed end 230 and the outer stressed end 231. In a further embodiment, the guide wheel 27 can rotate relative to the inner stressed end 230 and the outer stressed end 231. When the cleaning device 200 contacts with the guide wheels 27 on a left and a right side, the guide wheels 27 are tangential to the side wall of the cleaning device 200, avoiding the cleaning device 200 from jamming between the guiding mechanisms on the two sides.

Figure 10:
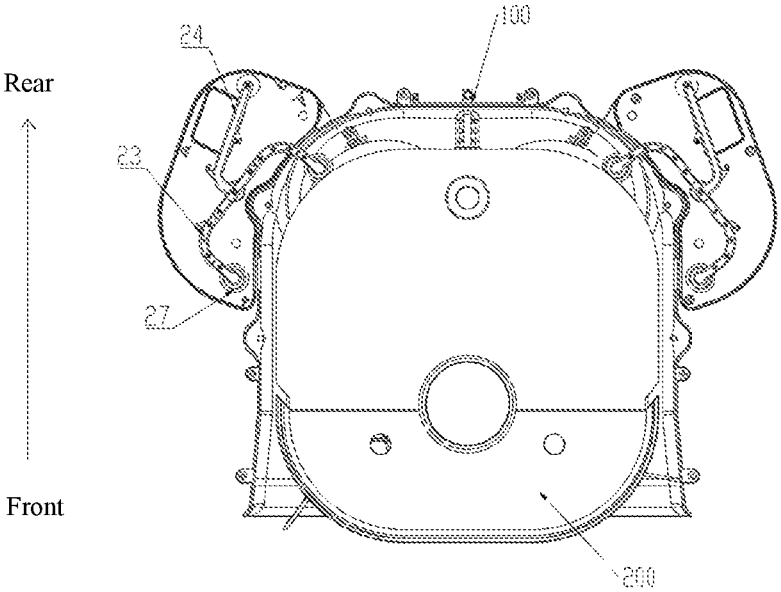
FIG. 10 is a schematic diagram of a structure of a cleaning device starting to enter a base station according to an embodiment of the present disclosure.
Figure 11:
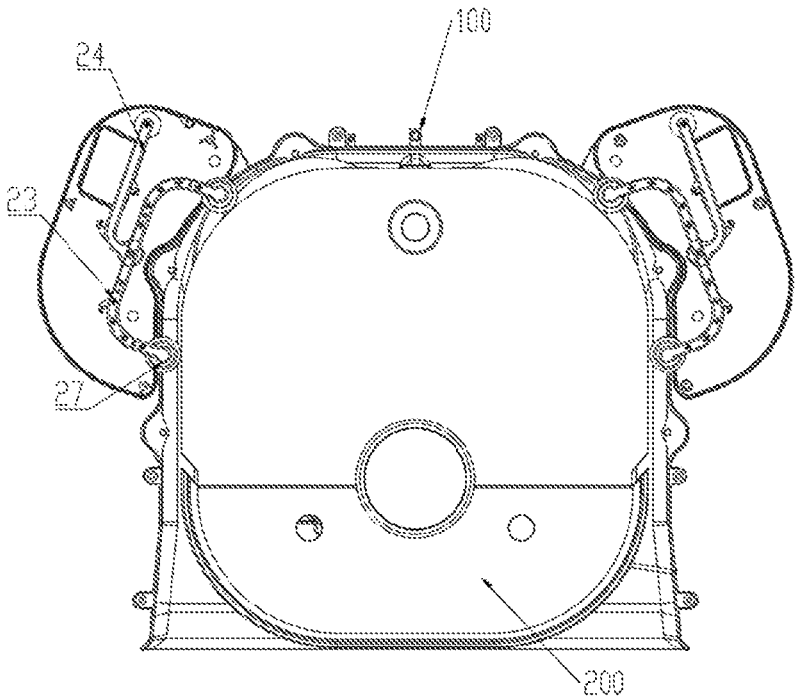
FIG. 11 is a schematic diagram of a structure of a cleaning device entering a base station according to an embodiment of the present disclosure.
Figure 12:
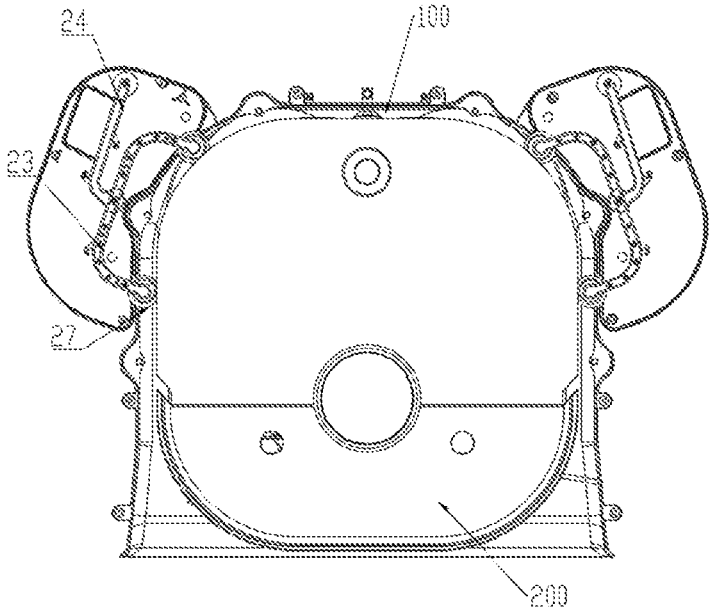
FIG. 12 is a schematic diagram of a structure of a cleaning device having completely entered a base station according to an embodiment of the present disclosure.

In a further embodiment, as illustrated in FIG. 10 to FIG. 12, when the cleaning device 200 does not contact with the first cranks 23, the first cranks 23 on the left and right side are arranged in a splayed shape. At this time, the inner stressed end 230 inserts into the accommodating chamber 101, and the outer stressed end 231 is located in the mounting box 22. When the cleaning device 200 enters the accommodating chamber 101, a head of the cleaning device 200 first abuts against the guide wheel 27 at the inner stressed end 230 and presses the guide wheel 27 at the inner stressed end 230 outwardly. The inner stressed end 230 is forced to drive the guide wheel 27 thereon to rotate counterclockwise around the second crank 24 over an angle, which in turn drives the outer stressed end 231 and the guide wheel 27 thereon to move in the direction close to the cleaning device 200. At this time, the second elastic member 25 is stretched and deformed, and the guide wheels 27 on both the left and right side will provide an initial stress in opposite directions to the cleaning device 200. Stresses on the left and right side will push the cleaning device 200 inwardly. When the cleaning device 200 is biased to one side, a deformation of the second elastic member 25 that is biased to is larger than a deformation of the other second elastic member 25, and the guide wheel 27 that the cleaning device 200 is biased to provides more stress than the other guide wheel 27, which in turn pushes the cleaning device 200 to the other side, until no stress difference exists between the stresses generated by the guide wheels 27 on the left and right side on the cleaning device 200, and the cleaning device 200 travels in a centered direction. As the cleaning device 200 enters, the guide wheels 27 at the inner stressed end 230 and the outer stressed end 231 on the left and right side simultaneously abut against the side wall of the cleaning device 200. The third elastic member 26 is stretched and deformed and provides an inward push force on the cleaning device 200. When the cleaning device 200 is biased to one side, the guiding mechanism that is biased to generate more stress on the cleaning device 200 than the other guiding mechanism. The guiding mechanisms on the left and right side generate a stress difference, and the cleaning device 200 moves toward the other side, achieving an object of correcting the cleaning device 200 to travel in the centered direction.

Figure 13:
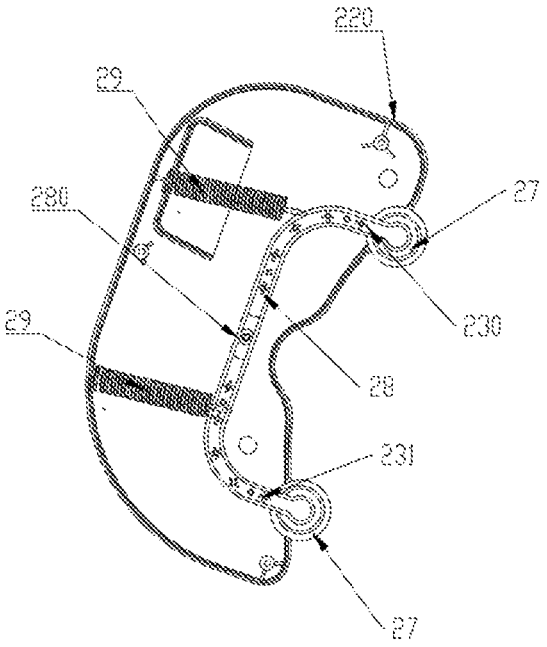
FIG. 13 is a schematic diagram of a structure of a guiding mechanism according to some embodiments of the present disclosure.

In other embodiments of the present disclosure, a centering guidance of the cleaning device 200 may further be achieved by the following guiding mechanism. As illustrated in FIG. 13, the guiding mechanism may include: a lever member 28, and two fourth elastic members 29. The lever member 28 has a pivot 280 connected to a top or bottom surface of the mounting box 22. The lever member 28 has an inner stressed portion 230 and an outer stressed portion 231. A guide wheel 27 is movably connected to each of the inner stressed portion 230 and the outer stressed portion 231. The lever member extends, from the inner stressed portion 230 to the outer stressed portion 231, outward obliquely. The fourth elastic members 29 are disposed between a side surface of the mounting box 22 and the inner stressed portion, and between the side surface of the mounting box 22 and the outer stressed portion of the lever member 28, respectively, for resetting the lever member 28.

In a further embodiment, as the cleaning device 200 enters into the accommodating chamber 101, the head of the cleaning device 200 first abuts against the inner stressed end and presses the inner stressed end 230 inwardly. At this time, the fourth elastic member 29 connected to the inner stressed end 230 is compressed and deformed. The outer stressed end 231 moves in the direction close to the cleaning device 200 during a process of the inner stressed end 230 being pressed. At the same time, the fourth elastic member 19 connected to the outer stressed end 231 is stretched and deformed, until the guide wheels 27 at the inner stressed end 230 and the inner stressed end 231 abut against the side wall of the cleaning device 200, and at this time, the guiding mechanisms on the left and right side generate an inward pushing stress on the cleaning device 200. If the cleaning device 200 moves biased to one side, the biased side will generate a push press biased to the other side on the cleaning device 200, to enable the cleaning device 200 to move along the centerline.

Figure 14:
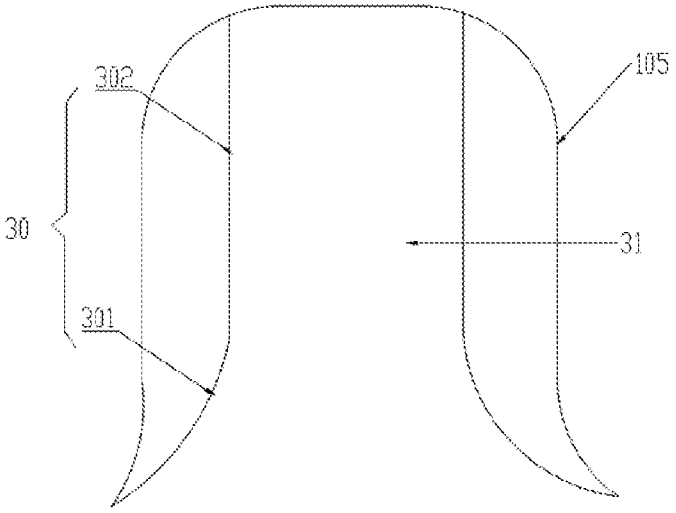
FIG. 14 is a schematic diagram of a structure of a guiding mechanism according to some other embodiments of the present disclosure.

In addition, in some embodiments of the present disclosure, the centering guidance of the cleaning device 200 may further be achieved by the following guiding mechanism. As illustrated in FIG. 14, the guiding mechanism is a guide strip 30 mounted in the accommodating chamber. A channel 31 for the cleaning device 200 to move is formed between the two guide strips 30. The opening 102 is located at a front end of the channel 31. Each of the guide strips 30 includes a first guide segment 301 disposed close to the front end of the channel and a second guide segment 302 connected to the first guide segment 301. The two second guide segments 302 are parallel to each other, and each of the two first guide segments 302 extends obliquely, from a connection with the respective second guide segment 302, to the opening 102 in a direction away from each other.

In a further embodiment, the cleaning device 200 moves between the two guide strips 30. With a limitation of the guide strips 30, the cleaning device 200 can only move within the channel 31, avoiding a movement bias of the cleaning device 200. In addition, in this embodiment, a width of the channel 31 gradually becomes narrower, guiding the cleaning device 200 to be between two second guide segments 302, and enabling the cleaning device 200 to move to a predetermined stopping area of the accommodating chamber 101.

It should be noted that, in an embodiment of the present disclosure, the first elastic member 16, the second elastic member 25, the third elastic member 26, and the fourth elastic member 19 may be springs. The second elastic member 25, the third elastic member 26 are, in some embodiments, tension springs.

Continuing to refer to FIG. 1, some embodiments of the present disclosure provide a cleaning system 1000, including the cleaning device 200 and the base station 100 as described in the above embodiments.

While the some embodiments of the present disclosure have been described above, the protection scope of the present disclosure is not limited to these embodiments. Various variants and alternatives can be easily conceived without departing from the scope of the present disclosure. Therefore, these variants and alternatives are to be encompassed by the protection scope of present disclosure as defined by the claims as attached.

What is claimed is:

1. A base station of a cleaning device, comprising:

a base station body having an accommodating chamber for accommodating the cleaning device and an opening for the cleaning device to enter or exit the accommodating chamber; and a water injection assembly comprising a movable base, and a movable plate, a lifting mechanism, and a water injection pipe that are disposed on the movable base, wherein the water injection pipe is configured to inject water into the cleaning device, the lifting mechanism is configured to drive the water injection pipe to move, a first elastic member is disposed between the movable plate and a side wall of the accommodating chamber, and the cleaning device is contacted with the movable plate during a water injection process of the water injection assembly.

2. The base station of the cleaning device according to claim 1, wherein the lifting mechanism comprises:

a drive motor mounted on the movable base;

a nut rotatably mounted in the movable base and connected to an output end of the drive motor; and a lead screw extending through the nut and engaged with the nut, the water injection pipe being fixedly mounted on the lead screw.

3. The base station of the cleaning device according to claim 2, wherein a limit protruding rib is disposed on the movable base, a limit groove is set on the lead screw, and the limit groove matches the limit protruding rib to limit a position of the lead screw.

4. The base station of the cleaning device according to claim 1, further comprising:

a controller, wherein a water volume sensor is disposed on the water injection pipe, and the controller is configured to control lifting up of the water injection pipe based on water volume information of the cleaning device fed back by the water volume sensor.

5. The base station of the cleaning device according to claim 1, wherein a charging spring piece is disposed on the movable plate, and the charging spring piece is configured to abut against a charging terminal of the cleaning device for charging the cleaning device.

6. The base station of the cleaning device according to claim 1, further comprising:

two guiding mechanisms spaced apart from each other and symmetrically disposed in the base station body, wherein the two guiding mechanisms are configured to generate opposing forces on opposite sides of the cleaning device, to guide the cleaning device to move along a centerline of the accommodating chamber.

7. The base station of the cleaning device according to claim 6, wherein each of the guiding mechanisms comprises:

a first crank having an inner stressed end and an outer stressed end, the first crank extending, from the inner stressed end to the outer stressed end, outward obliquely;

a second crank having a first end rotatably connected to the base station body and a second end rotatably connected to a middle portion of the first crank;

a second elastic member having a first end fixed on the outer stressed end and a second end fixed on the second crank; and a third elastic member having a first end fixed on the second crank and a second end fixed on the base station body, wherein the inner stressed end is subjected to an external force from the cleaning device, and the outer stressed end moves in a direction close to the cleaning device until the inner stressed end and the outer stressed end abut against a side wall of the cleaning device.

8. The base station of the cleaning device according to claim 7, wherein a guide wheel is mounted on each of the inner stressed end and the outer stressed end.

9. The base station of the cleaning device according to claim 6, wherein each of the guiding mechanisms comprises:

a lever member having a pivot connected to the base station body, an inner stressed portion and an outer stressed portion, the lever member extending, from the inner stressed portion to the outer stressed portion, outward obliquely; and a fourth elastic member disposed between the base station body and the lever member and configured to reset the lever member, wherein the inner stressed portion is subjected to an external force from the cleaning device, and the outer stressed portion moves in a direction close to the cleaning device until the inner stressed portion and the outer stressed portion abut against a side wall of the cleaning device.

10. The base station of the cleaning device according to claim 9, wherein a guide wheel is mounted on each of the inner stressed portion and the outer stressed portion.

11. The base station of the cleaning device according to claim 6, wherein each of the guiding mechanisms is a guide strip mounted in the accommodating chamber, a channel for a movement of the cleaning device is formed between two guide strips, the opening is located at a front end of the channel, each of the guide strips comprises a first guide segment disposed close to the front end of the channel and a second guide segment connected to the first guide segment, the first and second guide segments are parallel to each other, and each of the first and second guide segments extends obliquely, from a connection with the respective second guide segment, to the opening in a direction away from each other.

12. A cleaning system, comprising:

a base station of a cleaning device, comprising;

a base station body having an accommodating chamber for accommodating the cleaning device and an opening for the cleaning device to enter or exit the accommodating chamber; and a water injection assembly comprising a movable base, and a movable plate, a lifting mechanism, and a water injection pipe that are disposed on the movable base, wherein the water injection pipe is configured to inject water into the cleaning device, the lifting mechanism is configured to drive the water injection pipe to move, a first elastic member is disposed between the movable plate and aside wall of the accommodating chamber, and the cleaning device is contacted with the movable plate during a water injection process of the water injection assembly.

13. The cleaning system according to claim 12, wherein the lifting mechanism comprises:

a drive motor mounted on the movable base;

a nut rotatably mounted in the movable base and connected to an output end of the drive motor; and a lead screw extending through the nut and engaged with the nut, the water injection pipe being fixedly mounted on the lead screw.

14. The cleaning system according to claim 13, wherein a limit protruding rib is disposed on the movable base, a limit groove is set on the lead screw, and the limit groove matches the limit protruding rib to limit a position of the lead screw.

15. The cleaning system according to claim 12, further comprising:

a controller, wherein a water volume sensor is disposed on the water injection pipe, and the controller is configured to control lifting up of the water injection pipe based on water volume information of the cleaning device fed back by the water volume sensor.

16. The cleaning system according to claim 12, wherein a charging spring piece is disposed on the movable plate, and the charging spring piece is configured to abut against a charging terminal of the cleaning device for charging the cleaning device.

17. The cleaning system according to claim 12, further comprising:

two guiding mechanisms spaced apart from each other and symmetrically disposed in the base station body, wherein the two guiding mechanisms are capable of generating opposing forces on opposite sides of the cleaning device, to guide the cleaning device to move along a centerline of the accommodating chamber.

18. The cleaning system according to claim 17, wherein each of the guiding mechanisms comprises:

a first crank having an inner stressed end and an outer stressed end, the first crank extending, from the inner stressed end to the outer stressed end, outward obliquely;

a second crank having a first end rotatably connected to the base station body and a second end rotatably connected to a middle portion of the first crank;

a second elastic member having a first end fixed on the outer stressed end and a second end fixed on the second crank; and a third elastic member having a first end fixed on the second crank and a second end fixed on the base station body, wherein the inner stressed end is subjected to an external force from the cleaning device, and the outer stressed end moves in a direction close to the cleaning device until the inner stressed end and the outer stressed end abut against a side wall of the cleaning device.

19. The cleaning system according to claim 18, wherein a guide wheel is mounted on each of the inner stressed end and the outer stressed end.

20. The cleaning system according to claim 17, wherein each of the guiding mechanisms comprises:

a lever member having a pivot connected to the base station body, an inner stressed portion and an outer stressed portion, the lever member extending, from the inner stressed portion to the outer stressed portion, outward obliquely; and a fourth elastic member disposed between the base station body and the lever member and configured to reset the lever member, wherein the inner stressed portion is subjected to an external force from the cleaning device, and the outer stressed portion moves in a direction close to the cleaning device until the inner stressed portion and the outer stressed portion abut against a side wall of the cleaning device.

* * * * *